United States Patent [19]

Dubach et al.

[11] Patent Number: 4,910,916

[45] Date of Patent: Mar. 27, 1990

[54] SLIDING DOOR FITTING

[75] Inventors: Fredi Dubach, Adetswil; Erich Röck, Höchst, both of Austria

[73] Assignee: Julius Blum Gesellschaft m.b.H., Höchst, Austria

[21] Appl. No.: 214,643

[22] Filed: Jul. 1, 1988

[30] Foreign Application Priority Data

Jul. 23, 1987 [AT] Austria ..... 1864/87

[51] Int. Cl.[4] ..... E05D 15/58

[52] U.S. Cl. ..... 49/257; 312/331; 312/322

[58] Field of Search ..... 312/339, 322, 323, 257, 312/110; 49/257, 254

[56] References Cited

U.S. PATENT DOCUMENTS

| | | | |
|---|---|---|---|
| 523,690 | 7/1894 | Sinclair | 49/257 |
| 962,228 | 6/1910 | Kuersten | 49/257 |
| 3,722,964 | 3/1973 | Chitester et al. | 312/331 |
| 4,375,907 | 3/1983 | Vander Kool et al. | 312/110 |
| 4,729,612 | 3/1988 | Stone | 312/322 |

*Primary Examiner*—Dorner Kenneth J.
*Assistant Examiner*—Gerald A. Anderson
*Attorney, Agent, or Firm*—Wenderoth, Lind & Ponack

[57] ABSTRACT

A sliding door fitting includes at least two superjacently arranged guide rails each having a pivot member which is displaceable thereon and at which a door is mounted. Each pivot member includes a running plate which is provided on one side with rollers in the manner of a running carriage. A mounting plate for a hinge is mounted on the other side of the running plate, the hinge thus being movable along the guide rail.

11 Claims, 3 Drawing Sheets

A
1
2
3
4
5
6
10
11
12
13
14
15
16
17

SLIDING DOOR FITTING

The invention relates to a sliding door fitting comprising at least two superjacently arranged guide rails, each having a respective pivot member which is displaceable thereon and to which a furniture door is mounted, each pivot member including a running plate on one side of which are provided rollers in the manner of a running carriage.

In cabinets which are provided with conventional sliding door systems, the doors are laterally displaced along upper and lower rails so that one surface corresponding to the size of one door is always covered. In the case of a cabinet having two sliding doors, this surface corresponds substantially to half of the front surface of the cabinet. In the case of a cabinet with three sliding doors, this surface corresponds substantially to one third of the front surface of the cabinet, and so on.

DE-OS Nos. 2944 431 and 27 35 787 show foldable doors which consist of individual lamellas.

A cabinet system is known from AT-PS 364 111 in which a door is pivotally fastened to a frame or frame member, this frame member being movable directly at the cabinet by means of roller guides.

In this system the cabinet can in a conventional manner be opened by sliding one door of the cabinet. When the doors are pivoted simultaneously, it is possible to obtain access to the complete cabinet at the same time.

With respect of the present invention, the afore-mentioned system has the disadvantage that the doors are swung outwardly.

It is known to build television sets into cabinets, and it is often desired to cover such television sets by doors. If the doors are mounted by means of ordinary hinges, the doors can be swung outwardly but they limit the viewing angle since they project outwardly. If so-called 180° hinges are used it may happen that such opened doors damage adjoining cabinet doors.

The use of sliding doors is not possible in most cases since the door covering the front of the television set will, when being displaced, cover an adjoining door.

The above-mentioned sliding door systems have no advantage in spite of the combination of sliding and swinging doors because the doors project from the cabinet in the open condition.

SUMMARY OF THE INVENTION

It is the object of the invention to provide a sliding door fitting which makes it possible to swing the doors open in a conventional manner and then to push them into the body of the article of furniture, e.g. a cabinet, so that they are fully or almost fully received in the interior of the cabinet and do not limit the view into the cabinet and hence of the television set.

According to the invention, this is achieved in that the running plate is provided, on the side thereof opposite the side with rollers with a mounting plate for a hinge or with other fastening means for a hinge.

The use of sliding door fitting of the invention obviously is not restricted to built-in television sets. Rather, the inventive fitting can be used in all cases where a door in the swung open position is a visual or physical obstacle. A cocktail cabinet could, for example, advantageously be provided with sliding door fittings according to the invention.

It is a further object of the invention to facilitate mounting of the sliding door fittings in comparison with conventional fittings. According to the invention, this is achieved in that superjacently arranged running plates are connected by rod means which are telescopically displaceable.

The rod means are advantageously formed by two flat strips of metal which are connectable by means of pins or screws. If each strip is provided with a row of holes, each being spaced 32 mm from the other, each extending and shortening of the rod means corresponds to a standard hole row. The rod means may therefore be fastened to upper and lower running plates and arranged therewith and with guide rails on the furniture side wall. Thus, fastening bores for the guide rails are automatically set, the distances between such fastening bores being 32 mm or a multiple thereof. Previous measuring of the fastening holes is not necessary.

The holes in the strips are preferably key-shaped holes.

It is advantageously provided that rollers on each running plate are arranged in the four corners of a rectangle.

This arrangement permits lower tolerances than an arrangement of the rollers in a triangle and prevents tilting of the doors.

Guiding of the doors is enhanced still further by making the rollers of a flexible material, for example plastics material, and by providing a slightly clamping arrangement between each two rollers and a running flange of the respective guide rail.

The running plates advantageously are symmetrical.

To limit the running path of the running plates, stop rollers of plastics material are arranged at the ends of the guide rails in one embodiment of the invention.

The hinges which are mounted on the running plates are in a conventional manner provided with four hinge axles, the door, when being opened, thus being laterally lifted from respective side wall and guided past the guide rail.

BRIEF DESCRIPTION OF THE DRAWINGS

In the following an embodiment of the invention will be described in more detail with reference to the accompanying drawings without being limited to the illustrated features thereof, and wherein.

DESCRIPTION OF THE PREFERRED EMBODIMENT

Figures 1A, 1B:
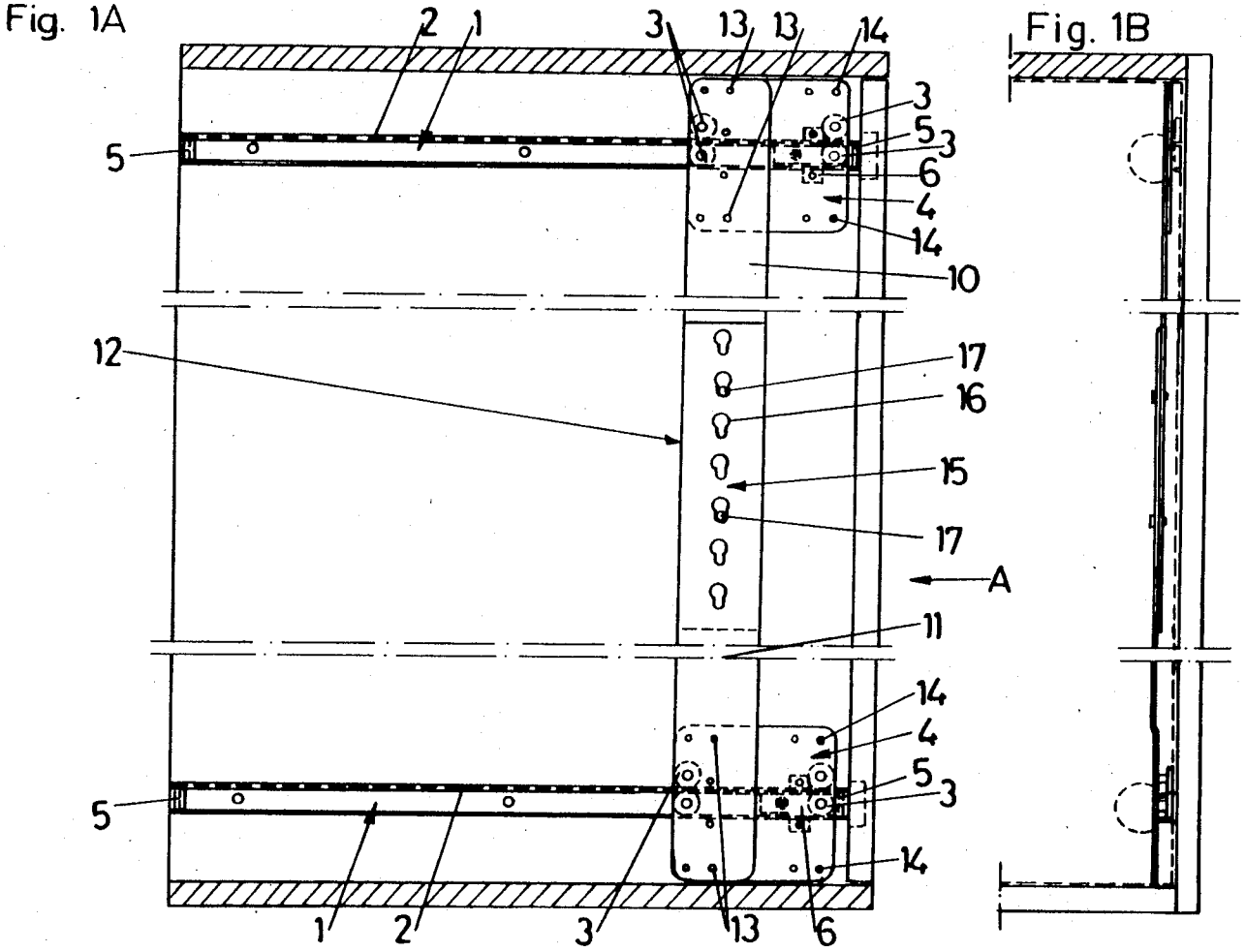
FIGS. 1A and 1B respectively are a diagrammatic side view and end view of a furniture side wall with sliding door fittings according to the invention.
Figure 2:
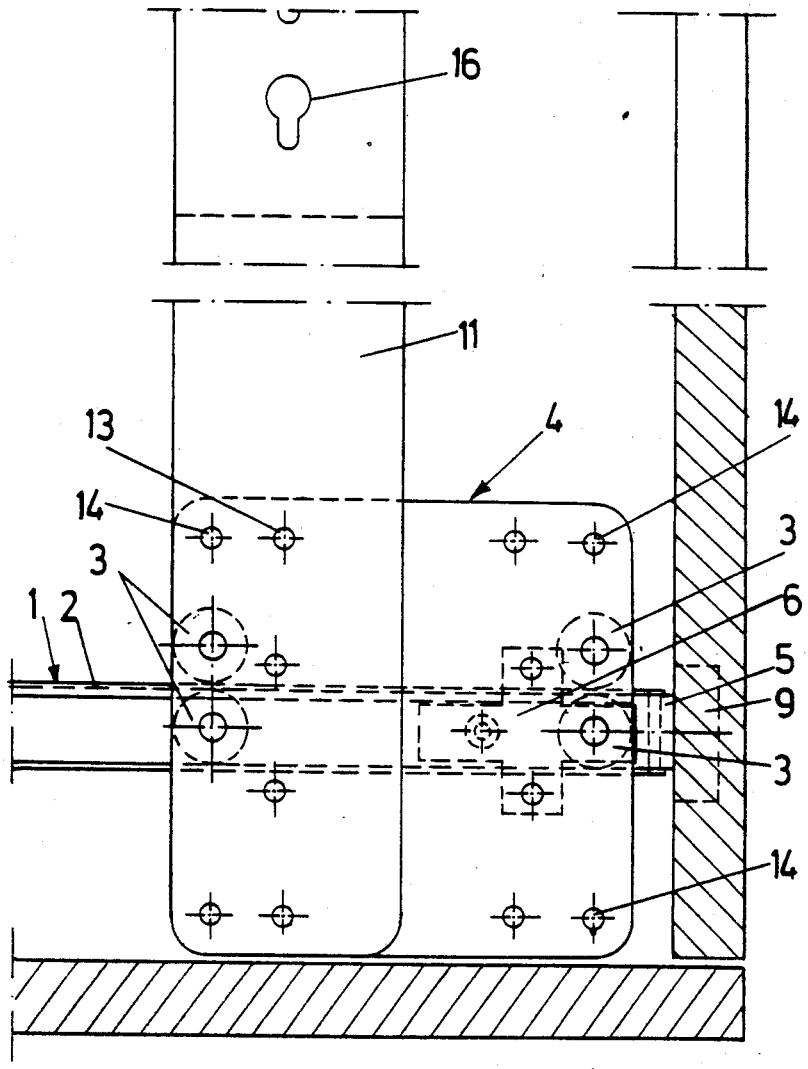
FIG. 2 is a side view of a running plate shown at an enlarged scale.
Figure 4:
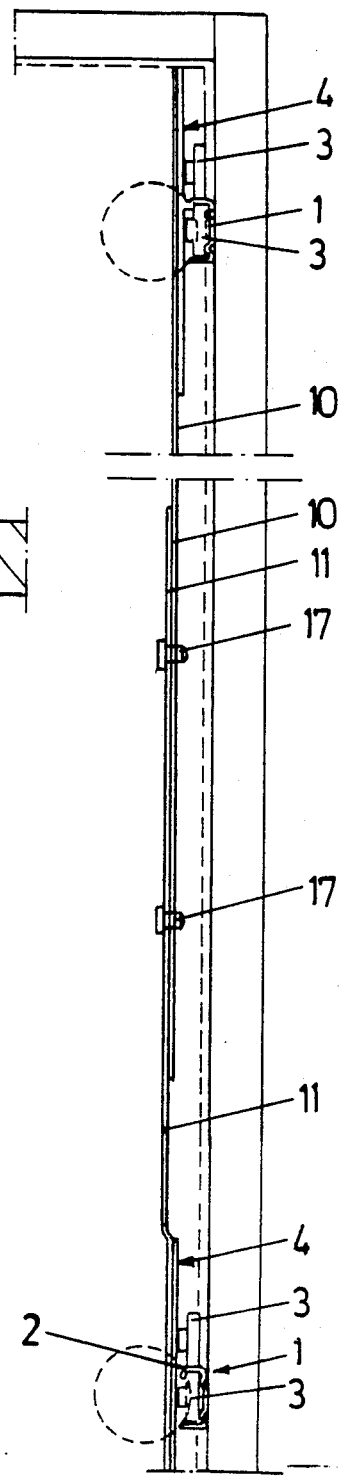
FIG. 4 is a view of the sliding door fitting from the direction of arrow A of FIG. 1A.
Figure 3:
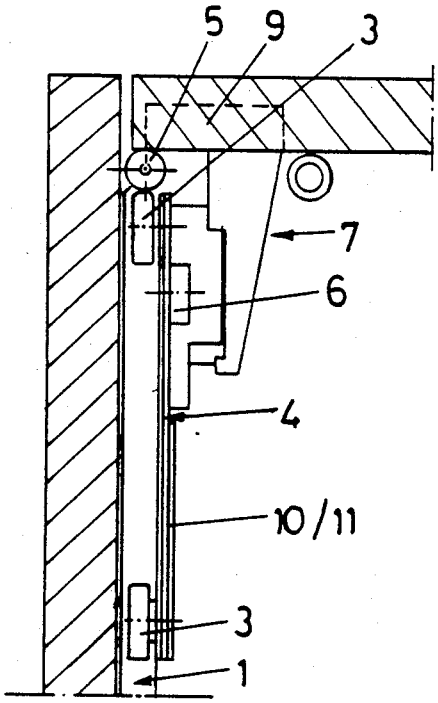
FIG. 3 is a top view of a running plate.

Each guiding fitting according to the invention comprises an upper and a lower guide rail 1 which in a conventional manner are fastened to a furniture side wall. In the illustrated embodiment, the guide rails 1 have U-shaped profiles, but they can equally have L-shaped profiles since running flanges 2 of the rails are embraced by rollers 3 of respective running plates or plate member 4.

Stop rollers 5 of plastics material are mounted at the two ends of each of the guide rails 1.

A respective running plate 4 is guided on each guide rail 1. Each running plate 4 on one side thereof is provided with four rollers 3 of plastics material which are mounted in the four corners of a rectangle in such a manner that two pairs of the rollers 3 receive therebetween the running flange 2 of the respective guide rail in a slightly clamping arrangement.

A mounting plate 6 for a furniture hinge 7 is fastened or fastenable to the other side of each running plate 4.

The furniture hinge is a conventional hinge, and therefore its construction need not be described in more detail. A door 8 is in a conventional manner provided with bores receiving a hinge casing 9 of hinge 7.

As can be seen from the drawings, the running plate 4 is symmetrical and can hence be mounted at any point of the cabinet.

The mounting plates 6 for the hinge 7 are mounted at the fronts of the respective running plate 4. Rod means 12, formed by two metal members or strips 10, 11, connects the rear portions of the two running plates 4 of the respective guide rails 1. The metal strips 10, 11 are connected with the respective running plates 4 by means of screws or rivets 13.

The two strips 10, 11 are both provided with a row 15 of holes 16 that are key-shaped and that are spaced by a distance of 32 mm from one another. This means that each shortening or extending of the rod means 12 corresponds to a distance of 32 mm or a multiple thereof.

For mounting the hinge fitting, it will therefore be sufficient, for example, to arrange the lower guide rail 1, in which the lower running plate 4 is engaged, on the furniture side wall in the desired position and then to extend the rod means 12 in such a manner that the upper running plate 4 comes to lie slightly underneath the upper edge of the side wall. The guide rail 1 is then at the correct height on the furniture side wall, and the position for the hole for the fastening screw therefor can be marked.

This process is first carried out at the front end of the guide rail. When the guide rails have been positioned at the front, the complete sliding door fitting is moved rearwards, whereupon the position of the upper guide rail 1 can be marked at the rear.

The two strips 10, 11 in the illustrated embodiment are connected by means of clamping screws 17.

What is claimed is:

1. A sliding door fitting comprising:

at least two guide rails to be arranged superjacently; each said guide rail having displaceably mounted thereon a respective pivot member comprising a plate member, a plurality of rollers on a first side of said plate member and guided on said guide rail, and means for mounting a hinge to be connected to a door on a second side of said plate member; and rod means fixed to said plate members to ensure that said pivot members are displaceable in unison along the respective said guide rails, said rod means having a vertically adjustable length to enable the vertical spacing between said plate members, and thus between said guide rails, to be selectively adjusted.

2. A sliding door fitting as claimed in claim 1, wherein said rollers of each said plate member are arranged in the four corners of a rectangle.

3. A sliding door fitting as claimed in claim 2, wherein said rollers are made of a flexible material, for example plastics, and two pairs of said rollers embrace a running flange of said guide rail in slightly clamping arrangement.

4. A sliding door fitting as claimed in claim 1, wherein said plate members are symmetrically constructed.

5. A sliding door fitting as claimed in claim 1, wherein said rod means comprise two flat strips connected to respective said plate members and adjustably connected to each other.

6. A sliding door fitting as claimed in claim 5, wherein said two flat strips are adjustably connected by pins or screws.

7. A sliding door fitting as claimed in claim 5, wherein said two flat strips are provided with respective rows of holes spaced at equal intervals.

8. A sliding door fitting as claimed in claim 7, wherein adjacent said holes of each said row are spaced by 32 mm.

9. A sliding door fitting as claimed in claim 7, wherein said holes are key-shaped.

10. A sliding door fitting as claimed in claim 1, further comprising stop rollers positioned at opposite ends of each of said guide rails.

11. A sliding door fitting as claimed in claim 1, further comprising a hinge supported by each said mounting means, said hinge including four hinge axles.

* * * * *